US009790906B2

(12) United States Patent
Imoehl

(10) Patent No.: US 9,790,906 B2
(45) Date of Patent: Oct. 17, 2017

(54) HIGH PRESSURE GASOLINE INJECTOR SEAT TO REDUCE PARTICLE EMISSIONS

(71) Applicant: Continental Automotive Systems, Inc., Auburn Hills, MI (US)

(72) Inventor: William James Imoehl, Williamsburg, VA (US)

(73) Assignee: CONTINENTAL AUTOMOTIVE SYSTEMS, INC., Auburn Hills, MI (US)

( * ) Notice: Subject to any disclaimer, the term of this patent is extended or adjusted under 35 U.S.C. 154(b) by 175 days.

(21) Appl. No.: 14/460,652

(22) Filed: Aug. 15, 2014

(65) Prior Publication Data

US 2016/0047343 A1 Feb. 18, 2016

(51) Int. Cl.

| | |
|---|---|
| ***F02M 51/06*** | (2006.01) |
| ***F02M 53/06*** | (2006.01) |
| ***F02M 61/18*** | (2006.01) |

(52) U.S. Cl.

CPC ..... *F02M 51/061* (2013.01); *F02M 53/06* (2013.01); *F02M 61/18* (2013.01)

(58) Field of Classification Search

CPC ..... F02M 51/061; F02M 53/06; F02M 61/18; F02M 61/1873; F02M 61/188; F02M 61/1886

See application file for complete search history.

(56) References Cited

U.S. PATENT DOCUMENTS

| | | | | |
|---|---|---|---|---|
| 4,301,655 | A * | 11/1981 | Thomas | F01K 21/02 60/712 |
| 4,629,127 | A * | 12/1986 | Kawamura | F02M 61/10 239/489 |
| 4,796,816 | A | 1/1989 | Khinchuk | |
| 5,467,924 | A * | 11/1995 | Buescher | F02M 57/02 239/533.3 |
| 5,915,352 | A * | 6/1999 | Okamoto | F02M 51/0671 123/298 |
| 6,786,433 | B2 | 9/2004 | Maier et al. | |

(Continued)

FOREIGN PATENT DOCUMENTS

| | | | |
|---|---|---|---|
| CN | 1386169 | A | 12/2002 |
| JP | S5229532 | U | 3/1977 |

(Continued)

OTHER PUBLICATIONS

Japanese Office Action dated Jun. 27, 2016 for corresponding Japanese application No. 2015-159849.

(Continued)

*Primary Examiner* — Darren W Gorman

(57) ABSTRACT

A fuel injector has a seat and at least one seat passage. The seat includes an outer tip surface through which the seat passage extends. Fin structure is provided in the outer tip surface and is constructed and arranged to increase a surface area of the outer tip surface as compared to a surface area of the outer tip surface absent the fin structure. The outer tip surface, including the fin structure, is constructed and arranged to be heated by combustion gases so that the outer tip surface reaches a temperature greater than a temperature that the outer tip surface would reach absent the fin structure, so as to cause evaporation of fuel that contacts the outer tip surface.

5 Claims, 2 Drawing Sheets

(56) References Cited

U.S. PATENT DOCUMENTS

| | | | | |
|---|---|---|---|---|
| 2004/0021014 | A1* | 2/2004 | Pilgram | F02M 51/0664 239/533.12 |
| 2004/0129806 | A1* | 7/2004 | Dantes | F02M 51/0685 239/533.12 |
| 2006/0043218 | A1* | 3/2006 | Holzgrefe | F02M 61/1846 239/533.12 |
| 2013/0048748 | A1* | 2/2013 | Imoehl | F02M 61/166 239/5 |

FOREIGN PATENT DOCUMENTS

| | | | |
|---|---|---|---|
| JP | 52029532 | | 5/1977 |
| JP | S58189367 | U | 12/1983 |
| JP | 63052967 | | 4/1988 |
| JP | 2006070755 | A | 3/2006 |
| JP | 2006322447 | A | 11/2006 |
| JP | 2008-169774 | | 7/2008 |

OTHER PUBLICATIONS

Japanese Office Action dated Feb. 20, 2017 for corresponding Japanese application No. 2015-159849.

Chinese Office Action and Search Report, and English translation of same dated May 19, 2017 for corresponding Chinese patent application 201510733818.9.

* cited by examiner

HIGH PRESSURE GASOLINE INJECTOR SEAT TO REDUCE PARTICLE EMISSIONS

FIELD

The invention relates to gasoline direct injection for vehicles and, more particularly, to providing an injector seat having an increased surface area that is exposed to hot combustion gases to increase a temperature of the seat and thus reduce particulate emissions.

BACKGROUND

Particulate emissions of gasoline engines will be newly regulated in Europe in 2014 with the introduction of EU6a regulations of $6\times10^{12}$ particles/km and further reduced to $6\times10^{11}$ particles/km with the introduction of EU6c in 2017. Similarly, United States regulations will impose similarly challenging standards with the introduction of LEVIII. Standards are assumed to be 10 mg/mi in 2014, 3 mg/mi in 2018 and 1 mg/mi in 2025. A major source of particulate emissions is known to be from a diffusion flame fed by fuel evaporating from the deposits on the fuel injector tip.

It is known that protruding the fuel injector further into the combustion chamber reduces the particulate emissions. Increasing injector tip protrusion raises injector tip temperature by exposing more injector tip surface area to hot combustion gases. This in turn enhances evaporation of any fuel remaining on the tip so there is no or little fuel remaining on the tip to be ignited when the flame front passes. The higher tip temperature also enhances oxidation of the deposits on the tip reducing the sponge-like surface of the deposits which hold the fuel.

Although a seemingly simple enhancement, increasing the injector tip protrusion in an existing engine and injector is neither simple nor inexpensive. If the injector is essentially unchanged, protrusion can only be increased by changing the design and machining of the cylinder head and the fuel rail. In a high volume scenario these are not simple, inexpensive changes. Similarly, making the injector longer instead of changing the engine components impacts highly automated component manufacturing, assembly and test equipment resulting in large tooling expenses, a non-standard product, and quality risks associated with tooling and component changeovers.

Thus, there is a need to increase the injector tip temperature to lower particulate emissions without impacting engine or injector machining and assembly tooling in any major way.

SUMMARY

An object of the invention is to fulfill the need referred to above. In accordance with the principles of the embodiments, this objective is obtained by providing a fuel injector having an inlet, an outlet, and a passageway providing a fuel flow conduit from the inlet to the outlet. The fuel injector includes a valve structure movable in the passageway between a first position and a second position. A seat is provided at the outlet and has at least one seat passage in communication with the passageway. The seat contiguously engages a portion of the valve structure in the first position thereby closing the seat passage and preventing fuel from exiting the seat passage. The valve structure in the second position is spaced from the seat passage so that fuel can move through the passageway and exit through the seat passage. The seat includes an outer tip surface through which the seat passage extends. Fin structure is provided in the outer tip surface and is constructed and arranged to increase a surface area of the outer tip surface as compared to a surface area of the outer tip surface absent the fin structure. The outer tip surface, including the fin structure, is constructed and arranged to be heated by combustion gases so that the outer tip surface reaches a temperature greater than a temperature that the outer tip surface would reach absent the fin structure, so as to cause evaporation of fuel that contacts the outer tip surface. A method of providing such a fuel injector is also disclosed.

In accordance with another aspect of a disclosed embodiment, a seat for a fuel injector includes surfaces defining at least one seat passage there-through. An outer tip surface is provided through which the least one seat passage extends. Means, in the outer tip surface, is provided for increasing a surface area of the outer tip surface as compared to a surface area of the outer tip surface absent the means. Wherein when the seat is placed in a fuel injector that is associated with an engine, the outer tip surface, including the means, is constructed and arranged to be heated by combustion gases so that the outer tip surface reaches a temperature greater than a temperature that the outer tip surface would reach absent said means, so as to cause evaporation of fuel that contacts the outer tip surface.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENTS

Figure 1:
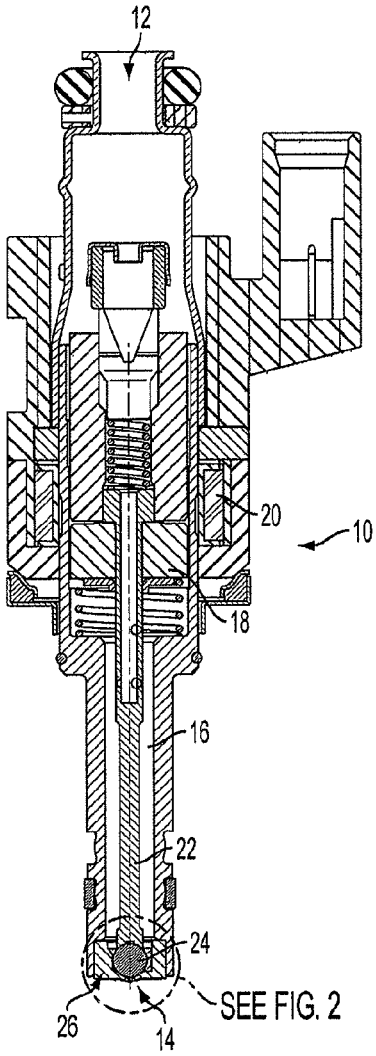
FIG. 1 is a view of gasoline direct fuel injector provided in accordance with an embodiment.

With reference to FIG. 1, a gasoline direct fuel injector is shown, generally indicated at 10, in accordance with an embodiment. The fuel injector 10 has a fuel inlet 12, a fuel outlet 14, and a fuel passageway 16 extending from the fuel inlet 12 to the fuel outlet 14. The injector 10 is of the conventional, solenoid-operated type, having an armature 18 operated by a coil 20. Electromagnetic force is generated by current flow from the electronic control unit (not shown) through the coil 20. Movement of the armature 18 also moves an operatively attached needle 22 and ball valve 24 to positions that are either separated from or contiguously engaged with a seat, generally indicated at 26. The needle 22 and ball valve 24 define valve structure of the injector 10. Instead of providing the ball valve 24, it can be appreciated that the valve structure could only comprise the needle 22, with an end of the needle engaging the seat 26.

Figure 2:
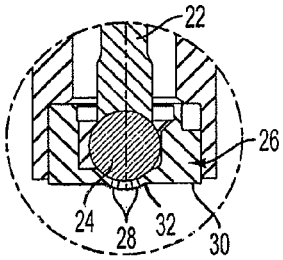
FIG. 2 is an enlarged view of the portion encircled at 2 in FIG. 1.

Movement of the ball valve 24 opens or closes, respectively, at least one metering orifice or seat passage 28 (FIG. 2) provided through the seat 26, which permits or inhibits, respectively, fuel from flowing through the fuel outlet 14 of the fuel injector 10. In the embodiment, a plurality of metering seat passages 28 is provided in a body of the seat 26. Surfaces defining more or fewer passages 28 can be provided depending on the application. The passages 28 extend through a hemispherical or convex protuberance 32 of an outer tip surface 30 of the seat 26. A planar surface 33 (FIG. 3A) of the outer tip surface 30 surrounds the protuberance 32. Surface 33 is preferably used to press the seat 26 into the valve structure of the injector 10. The outer tip surface 30 defines an end of the fuel injector 10 and can be considered to be the injector tip face. The protuberance 32 is often referred to as the "dimple".

Figure 3A:
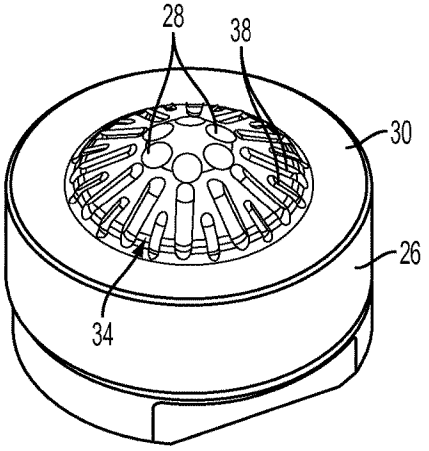
FIG. 3A is an enlarged view of the injector seat of the injector of FIG. 1, having a tip surface including fin structure provided in accordance with a first embodiment.
Figure 3B:
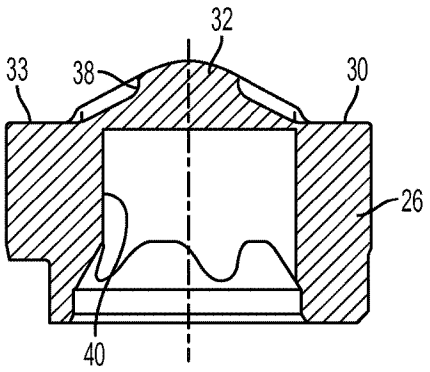
FIG. 3B is a cross-section of the injector seat of FIG. 3A, without showing the exit passages in the seat.

FIGS. 3A and 3B show the seat 26 including the protuberance 32 in accordance with an embodiment. In order to increase the surface area of the tip surface 30, fin structure, generally indicated at 34, is provided in the tip surface 30. In the embodiment, the fin structure 34 is provided in surfaces of the protuberance 32 of the tip surface 30, but can be provided in the planar surface 33 of the tip surface 30 if desired. In the embodiment of FIGS. 3A and 3B, the fin structure 34 is defined as a plurality of channels 38, in an outer surface of the protuberance 32, that extend radially from a center of the protuberance 32. The channels 38 are adjacent to the passages 28 but do not communicate with the passages 28 or with the passage 40, wherein the ball valve 24 resides. Passage 40 communicates with fuel passageway 16. The channels 38 can have the same or different lengths, widths and/or depths.

As a result of the outer tip surface 30 with the fin structure 34, when the injector is associated with an engine, the surface area of the tip surface 30 is increased, thereby increasing the temperature of the tip surface 30 in critical areas around the passages 28 and sac volume. Thus, the outer tip surface, including the fin structure, is constructed and arranged to be heated by combustion gases so that the outer tip surface 30 reaches a temperature greater than a temperature that the outer tip surface 30 would reach absent the fin structure 34, so as to cause evaporation of fuel that contacts the outer tip surface. This enhances evaporation, flash boiling and mixing. Also, by keeping the tip surface hot and evaporating any fuel before combustion, deposits on the tip surface can be minimized.

Figure 4A:
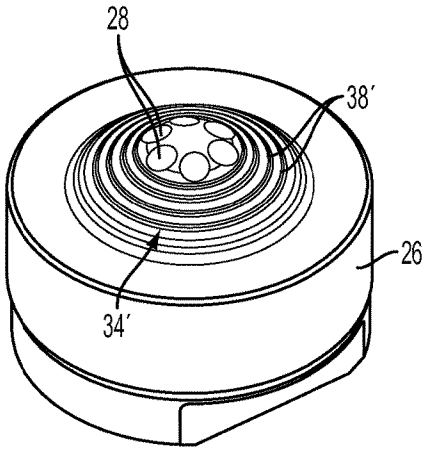
FIG. 4A shows an injector seat having a tip surface including fin structure provided in accordance with a second embodiment.
Figure 4B:
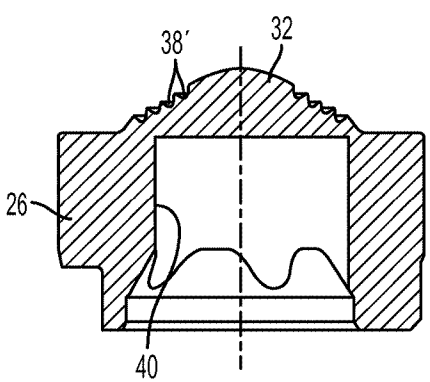
FIG. 4B is a cross-section of the injector seat of FIG. 4A, without showing the exit passages in the seat.

With reference to FIGS. 4A and 4B, another embodiment of the fin structure is shown, generally indicated at 34'. In this embodiment, the channels 38' are configured in generally concentric circles surrounding the passages 28. The channels 38' do not communicate with the passages 28 or with the passage 40. The channels 38' can have the same or different widths and/or depths. This embodiment is preferred since the seat 26 is typically a turned part and the fin structure 34' could be added to the screw machine process without significant impact on the cycle time.

Figure 5A:
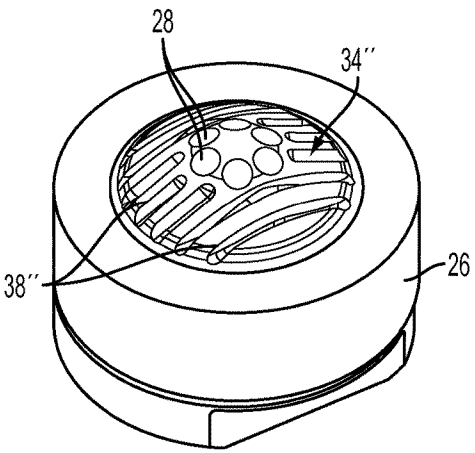
FIG. 5A shows an injector seat having a tip surface including fin structure provided in accordance with a third embodiment.
Figure 5B:
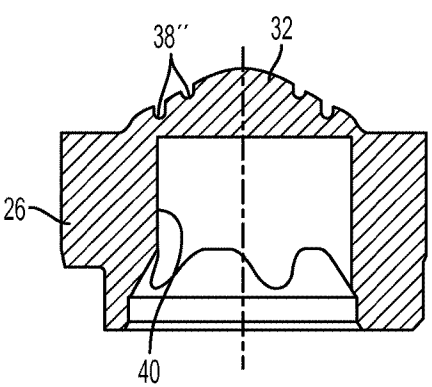
FIG. 5B is a cross-section of the injector seat of FIG. 5A, without showing the exit passages in the seat.

FIGS. 5A and 5B show yet another embodiment of the fin structure, generally indicated at 34". In this embodiment, the channels 38" extend linearly across the protuberance 32 and adjacent to the passages 28. The channels 38" are preferably aligned with the engine's intake airflow, charge motion and exhaust flow, which, in a typical four-valve engine with tumble flow, are all in the same direction. Aligning the channels 28" with the airflow increases the heat transfer coefficient which potentially increases the tip surface temperature further. The channels 38" do not communicate with the passages 28 or with the passage 40. The channels 38" can have the same or different lengths, widths and/or depths.

Another solution to increase the surface area of the outer tip surface 30 would be to increase the size and height of the protuberance 32. However, this approach has limits and disadvantages. First increasing the size and height of the protuberance 32 without changing the internal components such as the length of the fuel injector needle leads to thick sections which reduce the heat transfer to the fuel and leads to stepped orifice holes which are known not to be optimal for production. If thinner sections are maintained, the armature needle assembly must be lengthened, impacting component manufacturing and assembly tooling. Thinner sections on a larger protuberance 32 leads to potential structural problems with the seat.

Although FIGS. 3A, 4A and 5A shown various configurations of the fin structure, it can be appreciated that other configurations can be provided so long as the surface area of the tip surface 30 increases when compared to the tip surface absent the fin structure. The fin structure can be optimized based on maximizing surface area and shape of the channels to maximize heat transfer. The fin structure advantageously has no impact on engine design, fuel rail design and assembly tooling. Seat manufacturing tooling is impacted minimally. Also, instead of machining the fin structure, the fin structure can be formed easily in a metal injection molding process.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel injector having an inlet, an outlet, and a passageway providing a fuel flow conduit from the inlet to the outlet, the fuel injector comprising:

a valve structure movable in the passageway between a first position and a second position;

a seat, at the outlet, having at least one seat passage in communication with the passageway, the seat contiguously engaging a portion of the valve structure in the first position thereby closing the at least one seat passage and preventing fuel from exiting the at least one seat passage, the valve structure in the second position being spaced from the at least one seat passage so that fuel can move through the passageway and exit through the at least one seat passage, the seat including an outer tip surface through which the least one seat passage extends, and fin structure provided in the outer tip surface and constructed and arranged to increase a surface area of the outer tip surface as compared to a surface area of the outer tip surface absent the fin structure, a convex protuberance through which the at least one seat passage extends, the fin structure being provided in the protuberance, the convex protuberance being part of the outer tip surface;

the fin structure further comprising:

a plurality of channels in the protuberance provided in such a manner so as to not communicate with the at least one seat passage, and the channels are configured in concentric circles surrounding the at least one seat passage;

wherein the outer tip surface, including the fin structure, is constructed and arranged to be heated by combustion gases so that the outer tip surface reaches a temperature greater than a temperature that the outer tip surface would reach absent the fin structure, so as to cause evaporation of fuel that contacts the outer tip surface.

2. The fuel injector of claim 1, wherein the seat is generally cylindrical and includes a planar portion surrounding the protuberance.

3. A seat for a fuel injector, the seat comprising:

a body having surfaces defining at least one seat passage there-through, an outer tip surface through which the least one seat passage extends, and means, provided in the outer tip surface, for increasing a surface area of the outer tip surface as compared to a surface area of the outer tip surface absent said means, a convex protuberance through which the at least one seat passage extends, said means being provided in the protuberance, the convex protuberance being part of the outer tip surface;

said means further comprising:

a plurality of channels in the protuberance provided in such a manner so as to not communicate with the at least one seat passage, and the channels are configured in concentric circles surrounding the at least one seat passage;

wherein when the seat is placed in a fuel injector that is associated with an engine, the outer tip surface, including said means, is constructed and arranged to be heated by combustion gases so that the outer tip surface reaches a temperature greater than a temperature that the outer tip surface would reach absent said means, so as to cause evaporation of fuel that contacts the outer tip surface.

4. A method of reducing particulate emissions associated with a fuel injector, providing a fuel injector having an inlet; an outlet; a passageway defining a fuel flow conduit from the inlet to the outlet; a valve structure movable in the passageway between a first position and a second position; a seat, at the outlet, having at least one seat passage in communication with the passageway, the seat contiguously engaging a portion of the valve structure in the first position thereby closing the at least one seat passage and preventing fuel from exiting the at least one seat passage, the valve structure in the second position being spaced from the at least one seat passage so that fuel can move through the passageway and exit through the at least one seat passage, the seat including an outer tip surface through which the least one seat passage extends;

providing fin structure in at least a portion of the outer tip surface to increase a surface area of the outer tip surface as compared to a surface area of the outer tip surface absent the fin structures;

providing the outer tip surface to include a convex protuberance through which the at least one seat passage extends, and wherein the fin structure is provided in surfaces of the protuberance;

providing the fin structure as a plurality of channels in the protuberance in such a manner so as to not communicate with the at least one seat passage; and providing the channels to be configured in concentric circles surrounding the at least one seat passage;

heating the fin structure with combustion gases such that the outer tip surface reaches a temperature greater than a temperature that the outer tip would have reached absent the fin structure.

5. The method of claim 4, wherein the seat is provided as generally cylindrical and includes a planar portion surrounding the protuberance.

* * * * *